US007530460B2

(12) United States Patent
Lewis et al.

(10) Patent No.: US 7,530,460 B2
(45) Date of Patent: May 12, 2009

(54) DISPENSER FOR ROLLED SHEET MATERIAL

(75) Inventors: Richard Paul Lewis, Marietta, GA (US); Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 597 days.

(21) Appl. No.: 10/881,863

(22) Filed: Jun. 30, 2004

(65) Prior Publication Data

US 2006/0000845 A1 Jan. 5, 2006

(51) Int. Cl.

| | |
|---|---|
| ***B65D 85/00*** | (2006.01) |
| ***B65G 47/14*** | (2006.01) |
| ***B65G 59/00*** | (2006.01) |
| ***G07F 11/00*** | (2006.01) |

(52) U.S. Cl. ..... 206/409; 221/302; 221/282; 221/48; 221/45; 221/47; 221/1

(58) Field of Classification Search ..... 221/63, 221/45, 47, 48, 282, 302; 206/409
See application file for complete search history.

(56) References Cited

U.S. PATENT DOCUMENTS

| | | | | |
|---|---|---|---|---|
| 2,864,495 | A * | 12/1958 | Ritchie | 206/409 |
| 3,176,891 | A | 4/1965 | Goldsholl | |
| 3,523,653 | A | 8/1970 | Hansen | |
| 3,627,216 | A | 12/1971 | Ekuan | |
| 3,877,576 | A | 4/1975 | Kishi et al. | |
| 3,923,223 | A | 12/1975 | Larsson et al. | |
| 4,180,160 | A | 12/1979 | Ogawa et al. | |
| 4,262,816 | A * | 4/1981 | Margulies | 221/46 |
| 4,289,262 | A | 9/1981 | Finkelstein | |
| 4,373,687 | A * | 2/1983 | Zicko | 242/163 |
| 4,460,106 | A | 7/1984 | Moulding, Jr. et al. | |
| 4,524,895 | A | 6/1985 | Lunden | |
| 4,534,491 | A | 8/1985 | Norton et al. | |

(Continued)

FOREIGN PATENT DOCUMENTS

| | | |
|---|---|---|
| CA | 2452242 | 6/2004 |

(Continued)

OTHER PUBLICATIONS

ASTM Designation: D 3776-96, "Standard Test Methods for Mass Per Unit Area (Weight) of Fabric," pp. 86-89, published Jun. 1996.

(Continued)

*Primary Examiner*—Gene Crawford
*Assistant Examiner*—Rakesh Kumar
(74) *Attorney, Agent, or Firm*—Sue C. Watson; Ralph H. Dean, Jr.

(57) ABSTRACT

A single use disposable dispenser adapted to dispense sheet material therefrom is provided and includes a housing configured to provide a shipping carton and a dispenser housing for a roll of sheet material. The housing includes a base having a central area and an opening therein. The base is configured to support a roll of sheet material above at least a portion of the central area. The housing includes an exit port positioned a distance from the opening in the base. Sheet material disposed in the dispenser flows through the opening in the base and the exit port in a circuitous path.

20 Claims, 8 Drawing Sheets

U.S. PATENT DOCUMENTS

| | | | | |
|---|---|---|---|---|
| 4,579,266 | A | 4/1986 | Bünger et al. | |
| D285,995 | S | 10/1986 | Minost | |
| D296,765 | S | 7/1988 | Urion | |
| 4,756,460 | A | 7/1988 | Ornros | |
| 4,760,970 | A | 8/1988 | Larsson et al. | |
| 4,846,415 | A | 7/1989 | Jernberg et al. | |
| 4,899,905 | A * | 2/1990 | Holtsch | 221/63 |
| 4,905,868 | A | 3/1990 | Beane et al. | |
| 4,979,617 | A | 12/1990 | Benoit | |
| 5,065,924 | A | 11/1991 | Granger | |
| 5,131,561 | A | 7/1992 | Casperson et al. | |
| 5,141,171 | A | 8/1992 | Yang | |
| 5,205,455 | A | 4/1993 | Moody | |
| 5,211,308 | A | 5/1993 | Decker et al. | |
| 5,215,211 | A * | 6/1993 | Eberle | 221/1 |
| 5,219,126 | A | 6/1993 | Schutz | |
| D337,464 | S | 7/1993 | Giugiaro | |
| D339,014 | S | 9/1993 | Giugiaro | |
| D339,015 | S | 9/1993 | Giugiaro | |
| 5,246,137 | A | 9/1993 | Schutz et al. | |
| 5,263,607 | A | 11/1993 | Temesvary et al. | |
| 5,273,184 | A | 12/1993 | Rizzuto | |
| 5,310,083 | A | 5/1994 | Rizzuto | |
| 5,346,064 | A * | 9/1994 | Rizzuto | 206/409 |
| 5,370,338 | A | 12/1994 | Lewis | |
| 5,469,987 | A | 11/1995 | Honkawa et al. | |
| 5,480,060 | A | 1/1996 | Blythe | |
| 5,560,514 | A | 10/1996 | Frazier | |
| 5,577,634 | A | 11/1996 | Morand | |
| 5,577,635 | A | 11/1996 | Block | |
| 5,582,362 | A | 12/1996 | Johnson et al. | |
| D385,734 | S | 11/1997 | Mervar et al. | |
| 5,712,210 | A * | 1/1998 | Windisch et al. | 442/320 |
| 5,715,971 | A | 2/1998 | Morand | |
| 5,749,492 | A | 5/1998 | Petterson | |
| 5,762,286 | A | 6/1998 | Schutz | |
| 5,762,287 | A | 6/1998 | Schutz | |
| 5,765,718 | A | 6/1998 | Grasso et al. | |
| 5,769,354 | A | 6/1998 | Lindh et al. | |
| D396,369 | S | 7/1998 | Giugiaro | |
| 5,785,274 | A * | 7/1998 | Johnson | 242/593 |
| D403,543 | S | 1/1999 | Grasso et al. | |
| 5,857,642 | A | 1/1999 | Zinnbauer | |
| 5,868,346 | A | 2/1999 | Cobos | |
| 5,979,812 | A * | 11/1999 | Kotzur et al. | 242/163 |
| 6,062,422 | A | 5/2000 | Ellis | |
| 6,082,663 | A | 7/2000 | Tramontina et al. | |
| 6,086,012 | A * | 7/2000 | Kotzur et al. | 242/588.4 |
| 6,089,499 | A | 7/2000 | Robinson | |
| 6,129,240 | A | 10/2000 | Morand | |
| 6,145,782 | A * | 11/2000 | King et al. | 242/593 |
| 6,158,614 | A * | 12/2000 | Haines et al. | 221/63 |
| 6,182,858 | B1 | 2/2001 | Hartog | |
| 6,189,726 | B1 | 2/2001 | Fick | |
| 6,267,321 | B1 | 7/2001 | Tramontina | |
| D449,474 | S | 10/2001 | Conran et al. | |
| 6,328,252 | B1 | 12/2001 | Neveu et al. | |
| 6,354,426 | B1 | 3/2002 | Habisreitinger et al. | |
| 6,575,397 | B1 | 6/2003 | Tramontina et al. | |
| 6,629,667 | B2 * | 10/2003 | Tramontina | 242/593 |
| 6,945,424 | B1 * | 9/2005 | Gardner | 220/600 |
| 2003/0111480 | A1 | 6/2003 | Lewis et al. | |
| 2003/0122031 | A1 | 7/2003 | Tramontina et al. | |

FOREIGN PATENT DOCUMENTS

| | | |
|---|---|---|
| DE | 2222357 | 5/1972 |
| DE | 2818757 | 11/1979 |
| EP | 0107487 | 5/1984 |
| EP | 0117567 | 9/1984 |
| EP | 0128127 | 12/1984 |
| EP | 0091411 | 12/1985 |
| EP | 0061248 | 11/1986 |
| EP | 0068722 | 4/1988 |
| EP | 0238460 | 8/1990 |
| EP | 0231183 | 1/1991 |
| EP | 0550863 | 7/1993 |
| EP | 0480848 | 1/1994 |
| EP | 0740921 | 11/1996 |
| EP | 0642317 | 2/1997 |
| EP | 0836825 | 4/1998 |
| EP | 0595779 | 4/2000 |
| EP | 1066787 | 1/2001 |
| FR | 2667853 | 4/1992 |
| FR | 2667854 | 4/1992 |
| FR | 2668694 | 5/1992 |
| FR | 2669818 | 6/1992 |
| FR | 2681846 | 4/1993 |
| GB | 1455216 | 11/1976 |
| GB | 2038778 | 7/1980 |
| GB | 2063213 | 6/1981 |
| GB | 2120639 | 12/1983 |
| GB | 2145693 A * | 4/1985 |
| GB | 2145693 | 9/1986 |
| GB | 2244472 A * | 12/1991 |
| GB | 2270299 | 3/1994 |
| WO | WO 93/22963 | 11/1993 |
| WO | WO 93/22964 | 11/1993 |
| WO | WO 97/21377 | 6/1997 |

OTHER PUBLICATIONS

ASTM Designation: D 5035-95, "Standard Test Method For Breaking Force and Elorigation of Textile Fabrics (Strip Method)," pp. 682-688, published Jul. 1995.

TAPPI Official Test Method T 411 om-89, "Thickness (Caliper) of Paper, Paperboard, and Combined Board," published by the TAPPI Press, Atlanta, Georgia, revised 1989, pp. 1-3.

* cited by examiner

DISPENSER FOR ROLLED SHEET MATERIAL

BACKGROUND

Dispensers for centerflow rolls of sheet material products have become popular for dispensing sheet materials. Such dispensers usually do not rely on mechanical means to move or advance the roll. In a centerflow roll, the roll of sheet material product is formed with a hollow opening therethrough, and the sheets are removed from the hollow opening of a stationary roll rather than from a cylindrical outer surface of a roll which must be rotated.

These types of rolls are ideal for use in an industrial or commercial environment. Dispensers of such rolls, however, quickly become dirty, worn, and so forth. It would therefore be desirable to have a single use, disposable dispenser to dispense such rolls. Such a dispenser would provide one or more mechanisms to appropriately tension the sheet material flowing therethrough to allow withdrawal of one sheet at a time from a centerflow roll to prevent both user waste from excessive dispensing and user frustration from inadequate dispensing. The dispenser would also desirably provide both a shipping carton for the sheet material contained therein as well as a single use, disposable dispenser. Such a dispenser would permit easy transport and storage as well as proper dispensing.

DEFINITIONS

As used herein, the term "caliper" refers to the thickness measurement of a sheet taken under constant force. The caliper may be determined using test method number TAPPI 411-OM-89.

As used herein, the term "basis weight" (hereinafter "BW") is the weight per unit area of a sample and may be reported as gram-force per meter squared and may be hereinafter calculated using test procedure ASTM D3776-96.

As used herein, the term "machine direction" (hereinafter "MD") is the direction of a material parallel to its forward direction during processing.

As used herein, the term "machine direction tensile" (hereinafter MDT) is the breaking force in the machine direction required to rupture a specimen. The results may be reported as gram-force and abbreviated as "gf". The MDT may be determined using test method number ASTM D5035-95.

As used herein, the term "tab strength" is the breaking force in the machine direction required to rupture a sheet product along its perforations. The results may be reported as gram-force and abbreviated as "gf".

As used herein, the term "exit port" or "dispensing port" is the opening in a housing of a dispenser for the passage of sheet material out of the dispenser.

As used herein, the term "centerflow roll" or "centerflow roll product" means sheet material wound cylindrically about a center, but permitting the removal of material from the center. Desirably, as the centerflow roll is consumed, sheet material eventually dispenses from the roll's periphery. Dispensing of centerflow roll products are described in numerous patents, such as, but not by way of limitation, U.S. Pat. No. 5,370,338 to Lewis and U.S. Pat. No. 6,082,663 to Tramontina et al.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As user herein, the term "couple" includes, but is not limited to, joining, connecting, fastening, linking, or associating two things integrally or interstitially together.

These terms may be defined with additional language in the remaining portions of the specification.

SUMMARY OF THE INVENTION

In response to the difficulties and problems discussed above, a single use, disposable dispenser is provided which is adapted to dispense sheet material. The dispenser comprises a housing configured to provide a shipping carton for a roll of sheet material and a dispenser housing for dispensing sheets of material from the roll. The housing includes a base configured to support sheet material thereon. The base includes an opening therein. The housing includes an exit port positioned a distance from the opening in the base. The opening in the base and the exit port are positioned in a non-aligned configuration. Sheet material disposed in the dispenser flows through the opening in the base and the exit port in a circuitous path.

In another aspect of the invention, a single use, disposable dispenser is provided which is adapted to dispense sheet material. The dispenser comprises a housing configured to provide a shipping carton and a dispenser housing for sheet material. The housing includes a base having a central area and an opening therein. The base is configured to support sheet material above at least a portion of the central area. The housing includes an exit port positioned a distance from the opening in the base. Sheet material disposed in the dispenser flows through the opening in the base and the exit port in a circuitous path.

DETAILED DESCRIPTION

Figure 2:
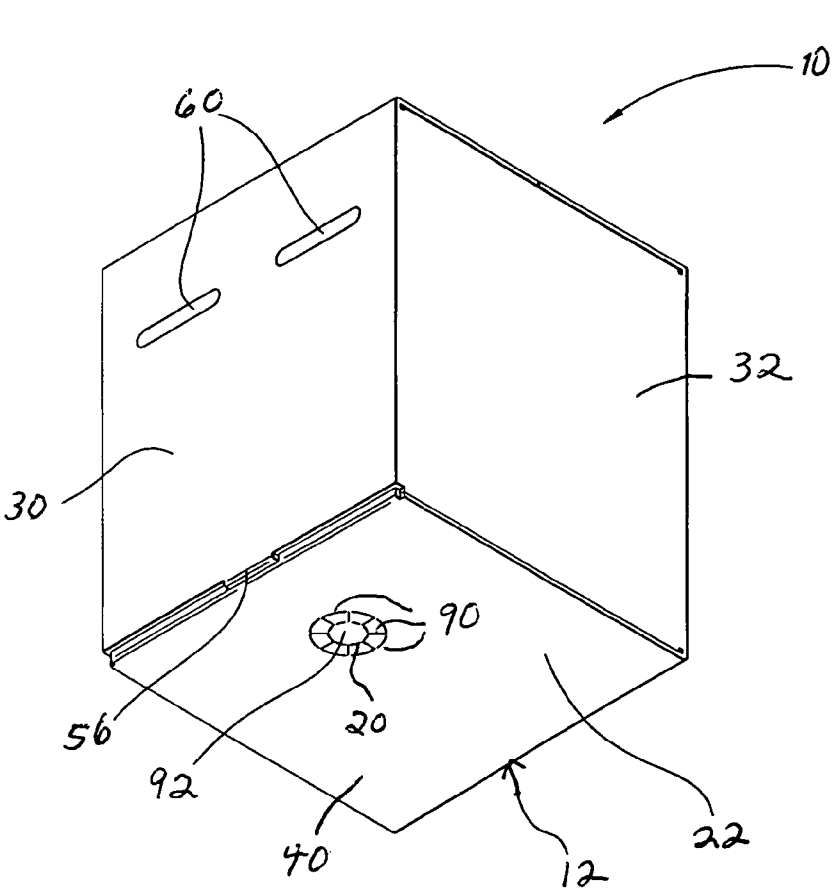
FIG. 2 is a perspective view of the dispenser of FIG. 1, showing a lower end having an exit port and a back side of the dispenser.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

Illustrated in FIGS. 1-12 is a dispenser 10 for rolled sheet material. As shown in FIGS. 1-6, the dispenser 10 includes a dispenser housing 12. The dispenser housing 12 is configured as a single-use, non-reusable, disposable dispenser housing 12 which provides both a shipping carton and a dispenser housing. The dispenser housing 12 provides an internal compartment 14 and the housing 12 is configured to hold a rolled sheet material product, such as tissue, towels, and so forth, within the internal compartment 14, desirably upon a base or tray 16 (FIGS. 7A-9C) which has a dispensing port or opening 18 therein. The dispenser housing 12 also includes an exit port 20, as shown in FIGS. 2-5, positioned, for example, in a lower end 22 thereof, although it will be understood that this position is not intended as a limitation, and the exit port 20 may be positioned on any area of the dispenser housing 12.

Figure 1:
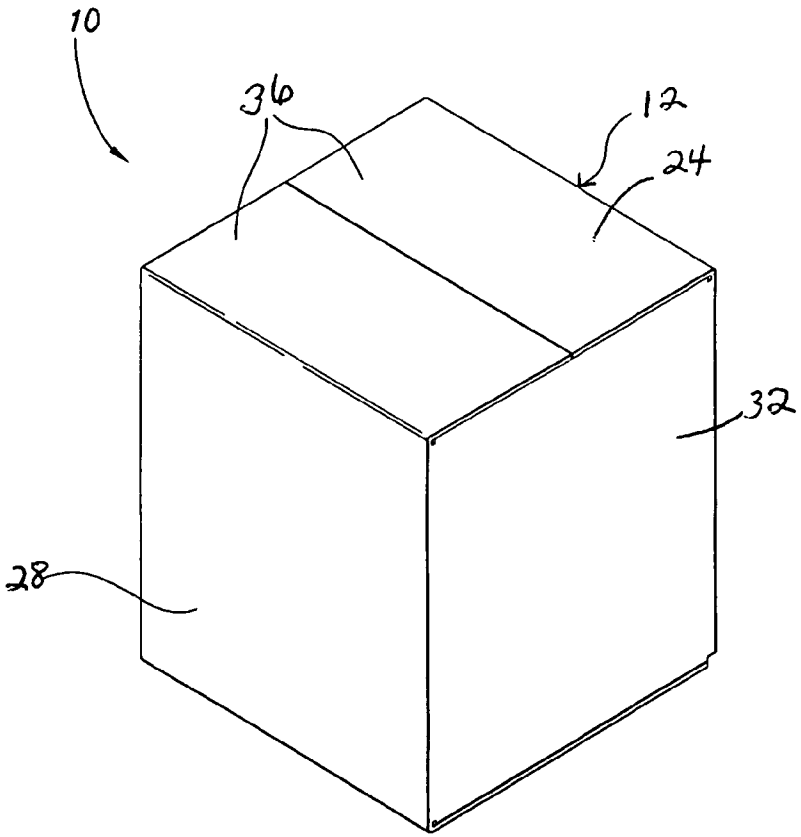
FIG. 1 is a perspective view of a dispenser of the present invention, showing a front side and an upper end of the dispenser.

The dispenser housing 12 is provided from a pre-cut blank (not shown) which is then folded and adhered or otherwise attached, but not by way of limitation, desirably to form a box-shaped configuration as shown in FIGS. 1 and 2. Such folds in portions of the box may act as hinges as well. The box or dispenser housing 12 has an upper end 24, a lower end 22, a front side 28, a back side 30, and a left and right side 32 which cooperate to form the generally box-shaped housing 12. Any dispenser housing, or any portion thereof shown and/or described herein is a non-limiting feature of the invention and may take any shape or configuration in accordance with any desired functional and/or aesthetic attributes.

In addition, the dispenser housing 12 may be made of any suitable material, or combination of materials. In the present instance, the dispenser housing 12 is desirably formed from a paper or wood product, such as cardboard, paperboard, light weight fiber board, light weight plastic, or any combination thereof.

Figure 4:
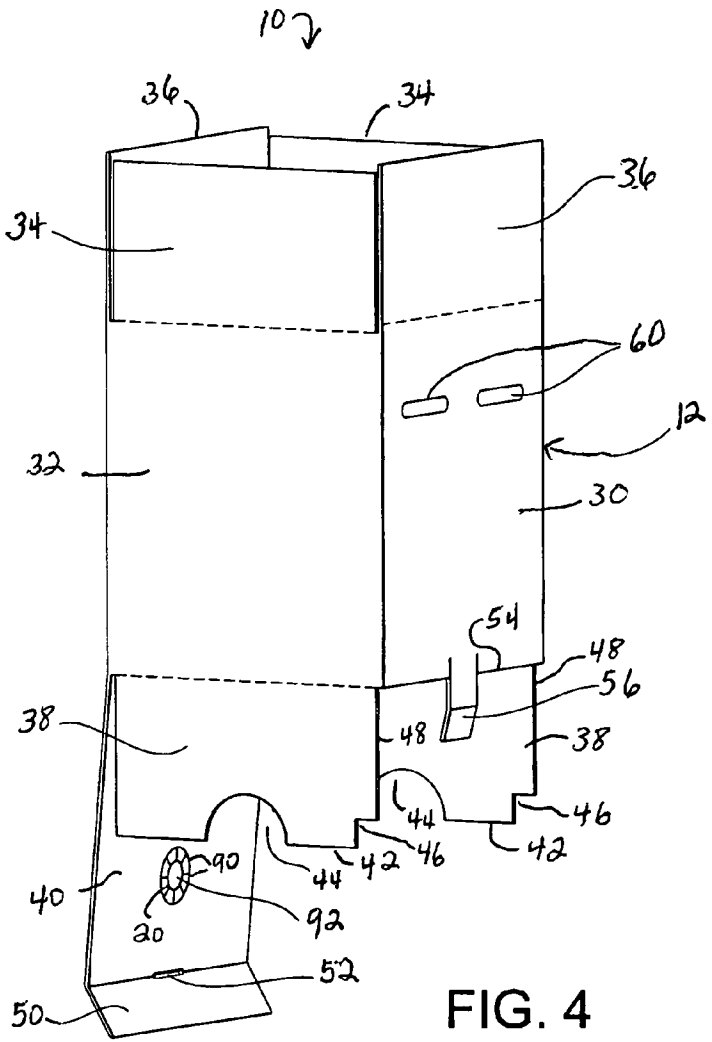
FIG. 4 is a perspective view similar to FIG. 3, showing the opened dispenser from another angle.
Figure 3:
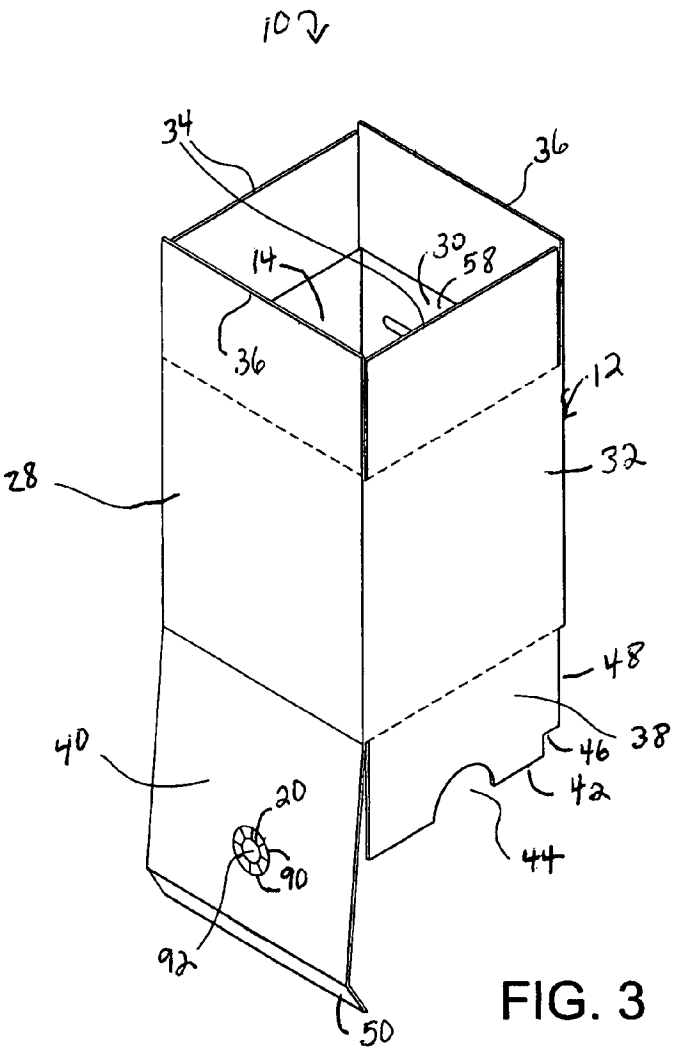
FIG. 3 is a perspective view of the dispenser of FIGS. 1 and 2, showing the dispenser housing in an opened position.
Figure 6:
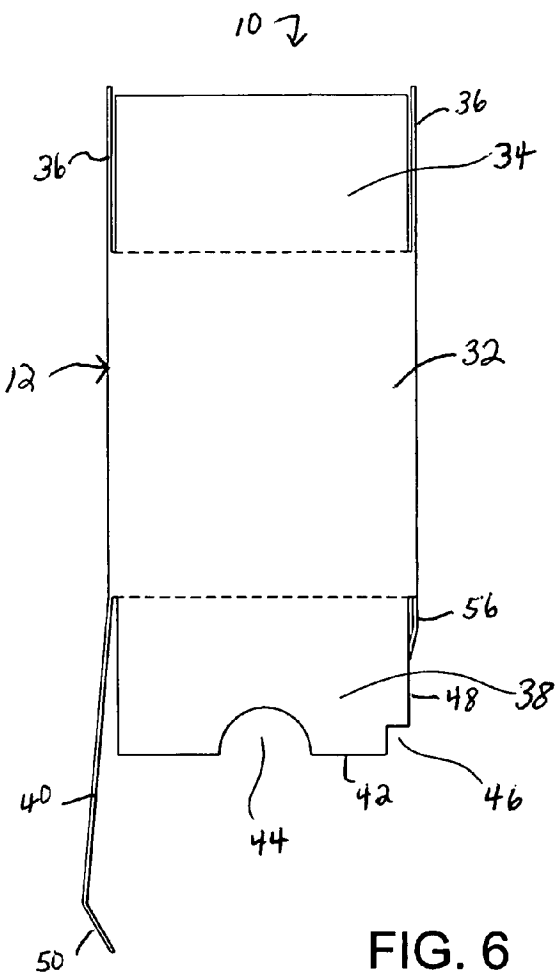
FIG. 6 is a side view of the opened dispenser of FIGS. 3 and 4, showing a left side view of the dispenser.
Figure 5:
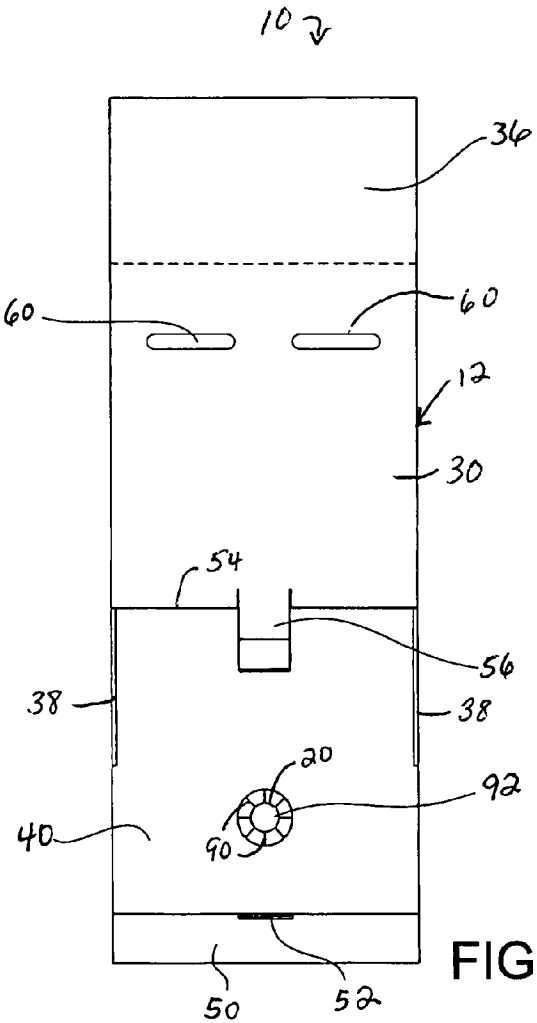
FIG. 5 is a side view of the opened dispenser of FIGS. 3 and 4, showing a back side of the dispenser.
Figure 7A:
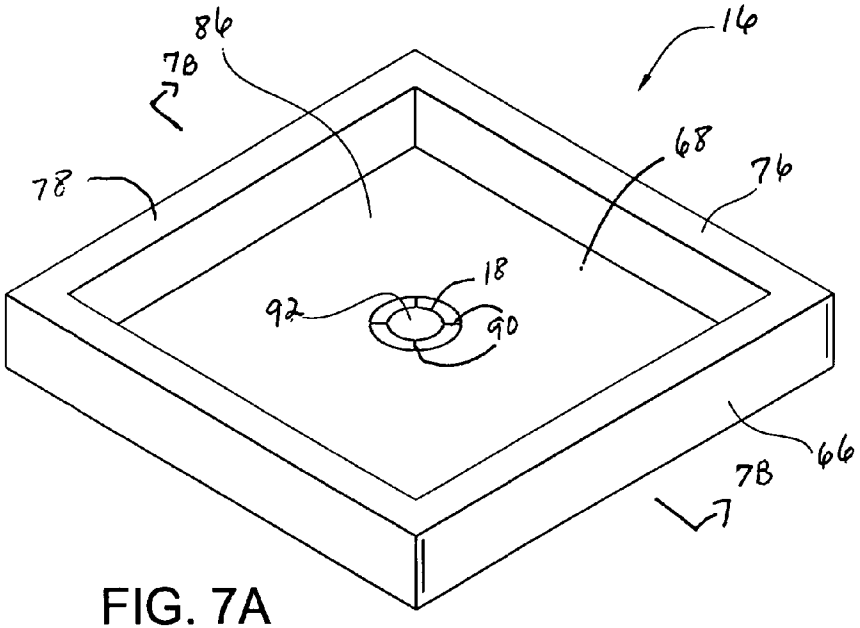
FIG. 7A a is a perspective view of a tray which is positioned in the dispenser.
Figure 7B:
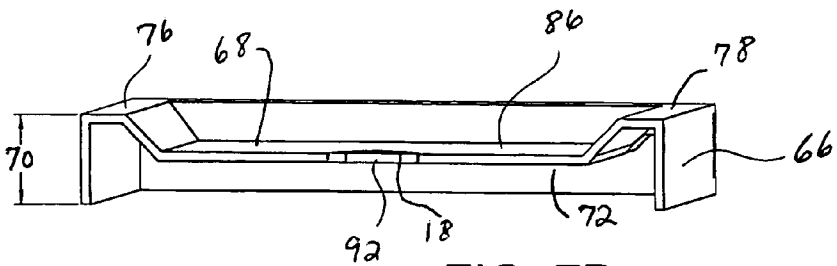
FIG. 7B is a sectional perspective view of the tray of FIG. 7A, showing the distance provided by landings positioned at a perimeter of the tray.

In the opened position, as illustrated in FIGS. 3 and 4, the upper end 24 of the dispenser housing 12 is desirably formed from two inner flaps 34 and two outer flaps 36. The inner flaps 34 or folded inward and then the outer flaps 36 are folded over the inner flaps 34 and are fastened thereto by adhesives, staples, and/or by any mechanism known in the art.

The lower end 22 of the dispenser housing 12 is formed from two inner flaps 38 and one outer flap 40. An inner edge 42 of each inner flap 38 includes a semi-circular cut out section 44 and a notch 46 provided at a junction of the inner edge 42 and a back edge 48. The outer flap 40 includes a folding portion 50 and has an opening 52 at a junction of the outer flap 40 and the folding portion 50. A lower edge 54 of the back side 30 includes a locking tab 56. To provide closure to the lower end 22, the two inner flaps 38 are folded inward, and the outer flap 40 is positioned in an overlapped position over the two inner flaps 38. The folding portion 50 of the outer flap 40 is positioned inward against an inner surface 58 of the back side 30; the notches 46 of the inner flaps 38 provides clearance between the folding portion 50 and the inner flaps 38 to permit the folding portion 50 to be positioned without interference from the inner flaps 38. The locking tab 56 is desirably positioned in the opening 52 to provide a releasable lock to the lower end 22 of the dispenser housing 12. While one embodiment of a box-shaped dispenser housing 12 is shown and described, it will be understood that the box-shape is not intended as a limitation.

The dispenser housing 12 may include attachments members or apertures 60. The apertures 60 may be perforated such that a tab of material is removed via the perforations (not shown) to provide the openings 60. Alternatively, however, the attachment members may include fasteners, hooks, hook and loop material (where one of the hook and loop material is positioned on the dispenser housing and the other hook and loop material is positioned on the surface to hold the dispenser housing), adhesives, and so forth. While the apertures 60 are illustrated on the back side 30, it will be understood that this is not a limitation, and the apertures 60 or attachment members may be located on any portion of the dispenser housing 12.

A base or tray 16 is positioned adjacent the lower end 22 of the dispenser housing 12 to hold at least a portion of a roll 62 of sheet material 64 (FIGS. 8 and 12) within the internal compartment 14 formed therein. The tray 16 extends transversely across the dispenser housing 12 and includes perimeter walls 66 which elevate an upper surface 68 of the tray 16. The roll 62 is held thereupon a distance 70 between a lower surface 72 of the tray 16 and an upper surface 74 of the lower end 22 of the dispenser housing 12. A landing 76 is provided along an upper end 78 of the perimeter walls 66. The landing 76 is configured to hold at least a portion of an outer periphery 80 of the roll 62. It will be appreciated that a single landing or a plurality of separate landings may be used. The landing 76 operates to distance the roll 62 and the sheet material 64 above the opening 18 in the tray 16, to permit the sheet material 64 to more easily unwind from a core 82 and an inner periphery 84 of the roll 62. Such a landing 76 decreases bunching and jamming of the sheet material 64, thereby decreasing the likelihood of the sheet material breaking off within the dispenser housing and becoming inaccessible to a user.

The tray 16 also includes a central recess or central area 86. As illustrated in FIGS. 7A-9C, the opening 18 is desirably positioned in a center of the central area 86. The central area 86 provides a space 88 between the roll 62 and the opening 18 by which the sheet material 64 is permitted to unwind and flow from the core 82 and inner periphery 84 of the roll 62 without frictional resistance from the central area 86.

The opening 18 in the tray 16 (shown in FIGS. 9A-9C, 11 and 12) and exit port 20 in the lower end 22 (illustrated in FIGS. 10A-12) are provided by perforations 90 which, when separated, permit a tab of material 92 to be removed to provide the opening 18 or the exit port 20. This feature permits the dispenser housing 12, when used as a shipping carton, to be substantially closed so that, desirably, no substantial moisture will enter the dispenser housing 12. Elements, such as moisture, may inhibit the flow of sheet material 64 from the dispenser 10; the sheet material 64 may clump and unwind improperly if it has absorbed and is holding moisture (not shown). Therefore, when the dispenser housing 12 is received as a shipping carton, it may be stored. When removed from storage for use, the perforations 90 are then desirably opened and the sheet material 64 theaded through the opening 18 and the exit port 20 to permit the shipping carton to function as a one-use, disposable dispenser housing 12.

Alternatively, it will be understood that the opening 18 and/or the exit port 20 may be provided without perforations 90 (not shown). As a further alternative, the opening 18 and/or the exit port 20 may be covered by a release sheet provided thereover (not shown). The sheet material may be threaded through the opening and/or the exit port prior to shipment. In such an alternative, for example, but not by way of limitation, the sheet material 64 may be threaded through the exit port 20 and a leading edge 94 (FIG. 11) may be folded down and held against an outer surface 96 of the lower end 22 of the dispenser housing 12 by a release sheet (not shown).

When the tab 92 of material is removed to provide the opening 18 and the exit port 20, it will be appreciated that, desirably, the edges 98 of the opening 18 and the edges 100 of the exit port 20 are disposed downwardly, in the direction of the flow of the sheet material 64, so as not to inhibit the flow of sheet material 64 therethrough. It will also be appreciated that the edges 98, 100 positioned about the opening 18 and the exit port 20, respectively, may be formed from the same material, or a different material than the material surrounding each. That is, for example, but not by way of limitation, the edge 98 of the opening 18 may be formed from cardboard, which is the same as the material surrounding the edge 98. The edge 100 of the exit port 20, however, may be formed from plastic, while the surrounding material is cardboard. It will be understood that other combinations are possible.

Any portion of the dispenser housing 12 may include other features, such as a cut-away area (not shown) covered by a polymer film which permits maintenance personnel to monitor when the roll is close to depletion (not shown). Such a cut away is desirably created when a tab formed by perforations is removed, or when an opening is covered by a clear, tinted and/or translucent polymer film.

Figure 8:
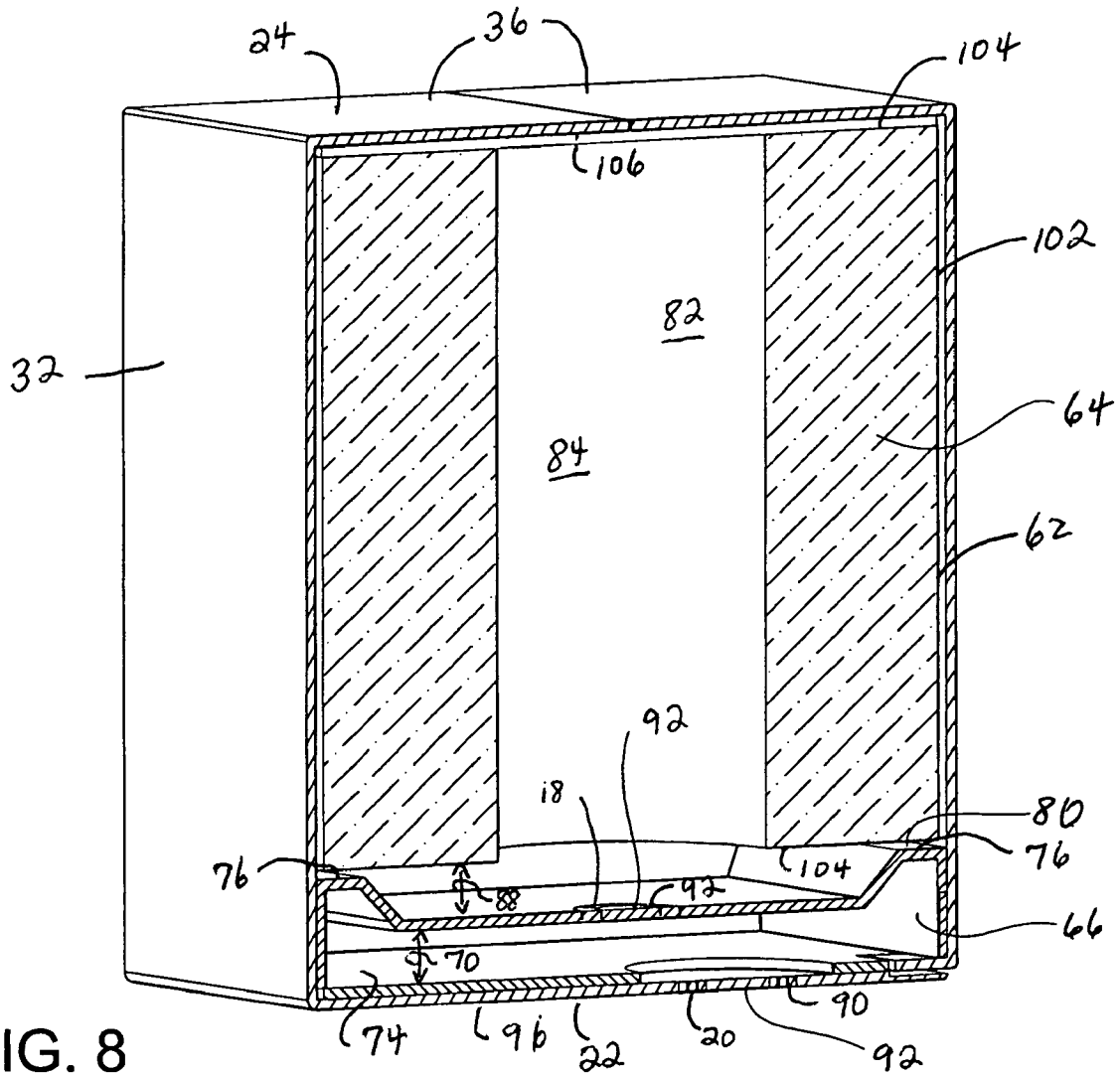
FIG. 8 is a sectional perspective view of the dispenser of FIGS. 1 and 2, showing a centerflow roll positioned in the dispenser and the position of the opening in tray and the exit port.
Figure 9B:
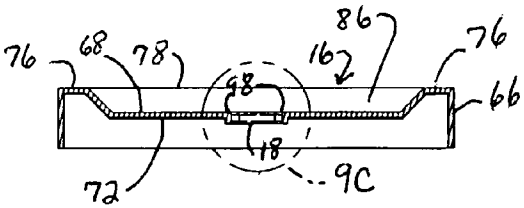
FIG. 9B is a sectional view of FIG. 9A taken along line 9B-9B.
Figure 9C:
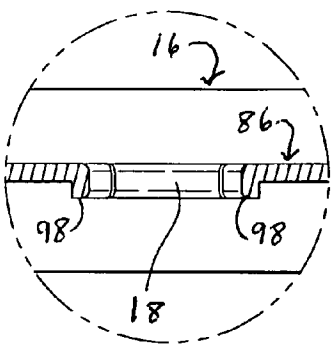
FIG. 9C is a partial view of the sectional view of FIG. 9B taken along line 9C.
Figure 9A:
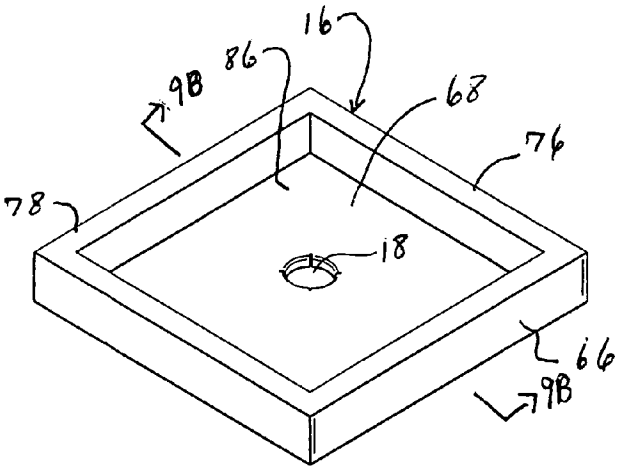
FIG. 9A is a perspective view of the tray and opening therein.
Figure 10B:
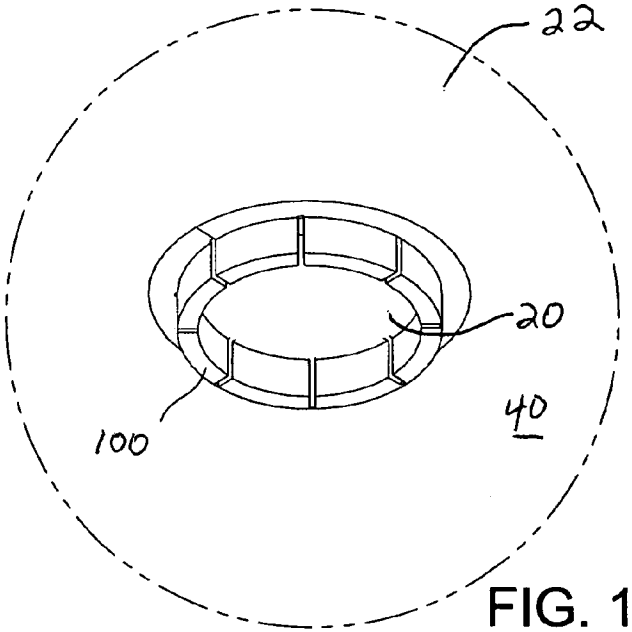
FIG. 10B is a partial view of FIG. 10A, taken along line 10B.
Figure 10A:
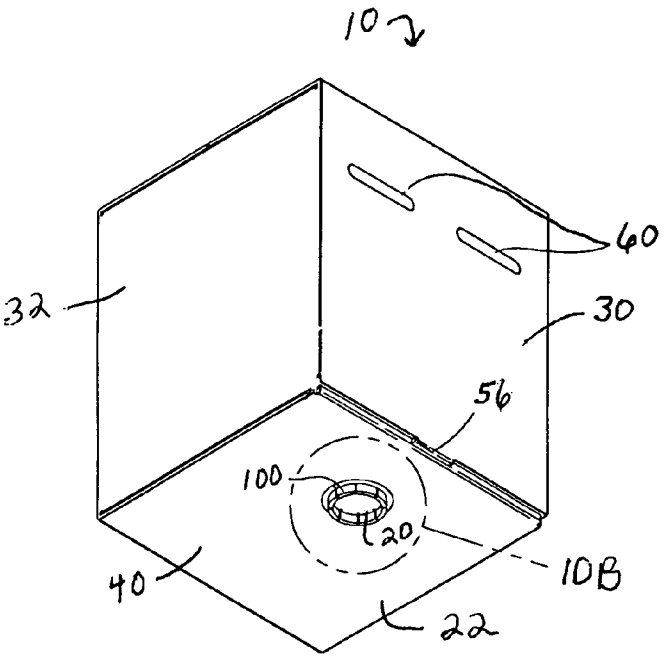
FIG. 10A is a perspective view of the dispenser similar to FIG. 2, but showing the opened exit port.
Figure 11:
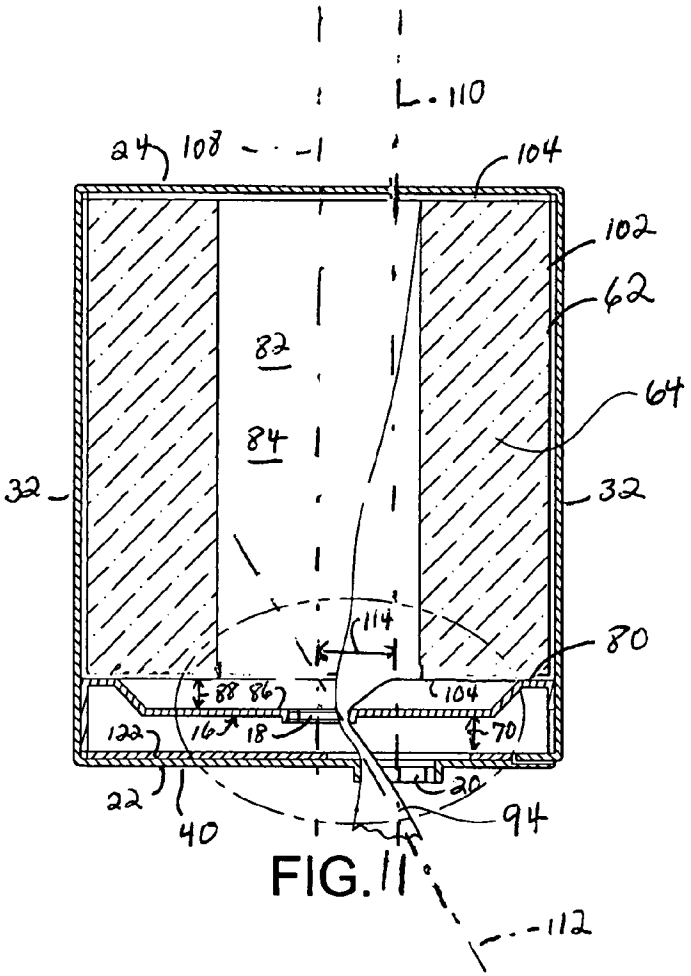
FIG. 11 is a sectional view of the dispenser of FIG. 1 taken along line 11-11.

As illustrated in FIGS. 8 and 11, a centerflow roll 62 of sheet material 64 is shaped such that it includes a cylindrical body 102 positioned between flat ends 104. An opening is positioned through the center of each flat end 104 and extends axially through the cylindrical body 102 to provide the core 82. The core 82 defines the inner periphery 84 of the roll 62. The roll 62 is designed, but not by way of limitation, to permit sheet material 64 to flow and be withdrawn from the inner periphery 84 to an outer periphery 80 of the roll 62, thereby permitting the roll 62 to unwind with little if any movement of the roll 62 while sheet material 64 is withdrawn by a user.

The sheet material 64 may be a single ply product or a multiple ply product. The sheet material may have a single perforation or line of perforations. Alternatively, a multiply sheet material product may include one or more perforations that are offset relative to each other on two or more plies of the sheet material. One example of this offset is when a two ply sheet material product includes perforations of the second ply located in a position approximately half-way between the perforations of the first ply. When dispensed, desirably the first ply separates from the roll and half of the second ply is exposed for use. Such offset perforations are known in the art, and are disclosed and described in detail in U.S. Pat. No. 3,877,576 issued to Kishi, et al. on Apr. 15, 1975, which is hereby incorporated by reference herein in its entirety for all purposes.

The roll 62 is positioned in the dispenser housing 12 such that the core 82 and the inner periphery 84 are positioned over the opening 18 in the tray 16. Desirably, but not by way of limitation, the core 82 and inner periphery 84 are axially aligned with the opening 18. A portion of the outer periphery 80 of one flat end 104 is positioned against the landing 76. The opposite flat end 104 is positioned adjacent an inner surface 106 of the upper end 24. The outer periphery 80 of the roll is positioned adjacent the left and right sides 32 and the front and back sides 28, 30.

Figure 12:
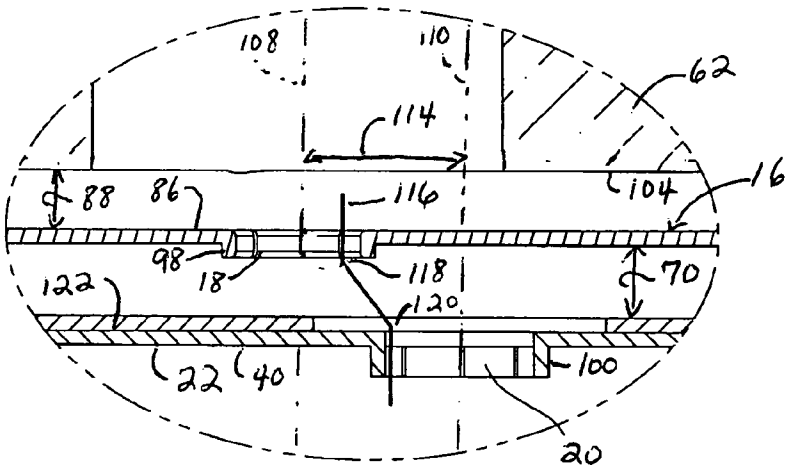
FIG. 12 is a partial view of the dispenser of FIG. 11 taken along line 12.

The roll 62 is positioned in the dispenser housing 12 such that a first axis 108 extends through the core 82 and inner periphery 84 of the roll 62 and through the opening 18 in the tray 16 in an axial alignment. A second axis 110 extends through the exit port 20. The first axis 108 and the second axis 110 are desirably positioned in a spaced-apart but parallel alignment relative to each other. The sheet material 64 flows between the opening 18 in the tray 16 and the exit port 20 in the lower end 22 on a third axis 112, which is positioned at an oblique angle relative to the first axis 108 and the second axis 110, and which intersects the first axis 108 and the second axis 110 (FIG. 12). As illustrated in FIG. 12, the opening 18 and the exit port 20 are spaced a distance 114 apart as well.

The path followed by the sheet material 64 as it flows from the roll 62 through the space 88 between the flat end 104 and the central area 86, through the opening 18, through the distance 70 between the lower surface 72 of the tray 16 and the upper surface 74 of the lower end 22 as well as the distance 114 between the opening 18 and the exit port 20 and through the exit port 20 is circuitous. In this embodiment, it is shown is a serpentine path 116 which forms a sideways "S" or "Z" shape, as shown in FIG. 12. That is, the sheet material 64 flows from an inner periphery 84 of the roll 62 through the space 88 and the opening 18 in the tray 16 and is forced to turn as it passes through the opening 18, thereby providing a first angle 118. The sheet of material 64 continued to flow from the opening 18 through the distance 70, 114 from the opening 18 to the lower end 22 and through the exit port 20, where it is forced to turn again as it passes through the exit port 20, providing a second angle 120.

Tension or frictional resistance is controlled in the dispensing of the sheet material 64 by the size and configuration of the opening 18 in the tray 16 and the size and configuration of the exit port 20. Tension or frictional resistance is also controlled by the amount of alignment or non-alignment of the opening 18 and the exit port 20, as well as the distance 70, 114 between the two. Reducing the size of the opening 18 and/or the exit port 20 results in greater tension or frictional resistance. Enlarging the size of the opening 18 and/or the exit port 20 results in less tension or frictional resistance. Reducing the distance 70, 114 between the opening 18 and the exit port 20 reduces the tension; increasing the distance 70, 114 increases the tension. Creating a greater amount of non-alignment (i.e., a greater distance 114 between the first axis 108 and the second axis 110, thereby decreasing the degrees in the first angle 118 and/or second angle 120) of the opening 18 and the exit port 20 results in greater tension; reducing the amount of non-alignment, i.e., the distance 114, reduces the tension or frictional resistance of the sheet material 64.

It will be appreciated that different combinations may be used to obtain the desired tension or frictional resistance for appropriate withdrawal of the sheet material 64 from the roll 62, i.e., one sheet at a time. Such adjustability reduces waste from excessive dispensing and frustration from sheet material which breaks off within the dispenser housing 12 and is therefore not available to be dispensed to a user. Such tension and frictional resistance control and adjustment may also be based upon the characteristics of the sheet of material, such as, for example, basis weight, caliper, machine direction tensile, tab strength, and so forth.

Adjustment to create less tension is used with a thinner, weaker, decreased basis weight and/or caliper sheet material, resulting in less tension and less frictional resistance to provide appropriate withdrawal or dispensing. Adjustment to create greater tension is used with a thicker, increased basis weight and/or increased caliper sheet material, resulting in greater tension and greater frictional resistance to permit appropriate dispensing.

In a method of use, a dispenser 10 having an exit port 20 is provided. Maintenance personnel open the dispenser housing 12 by removing the locking tab 56 from the opening 52 in the folding portion 50 and by moving the outer flap 40 away from the inner flaps 38. The inner flaps 38 are moved outward as well, exposing the tray 16. The tray 16 is removed and the leading edge 94 of the sheet material 64 is positioned through the opening 18 in the upper surface 68 of the tray 16 (any perforations 90 opened and any tab 92 removed previously). The upper surface 68 of the tray 16 is re-positioned against the flat end 104 of the roll 62, and the lower flaps 38 are moved inwardly against the lower surface 72 of the tray 16. The semi-circular cut outs 44 on the inner edge 42 of the inner flaps 38 are positioned so that the flow of sheet material 64 therepast is not hindered. The leading edge 94 of the sheet material 64 is positioned adjacent an upper surface 122 of the outer flap 40 and it is threaded through the exit port 20. The outer flap 40 is positioned over the inner flaps 38 and the folded portion 50 of the lower flap 40 is positioned adjacent the inner surface 58 of the back side 30. The locking tab 56 provided on the lower edge 54 of the back side 30 is inserted into the opening 52 in the outer flap 40, and the dispenser housing 12 is closed and releasably locked. The dispenser 10 may then be positioned against a surface via the aperture 60 or other attachment member(s) for dispensing.

While certain characteristics are described in a specific embodiment, any one or more characteristics, features, and/or elements may be used in any combination to create a particular embodiment from the disclosures, teachings, and/or suggestions provided herein. While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A single use disposable dispenser adapted to dispense sheet material, the dispenser comprising:

a housing configured to provide a shipping carton for a roll of sheet material and to provide a dispenser housing for dispensing sheets of material from the roll, the housing comprising an internal compartment, positioned within the internal compartment is a base configured to support sheet material thereon, the base comprising an opening therein positioned on a first axis, the housing comprising an exit port positioned a distance from the opening in the base, wherein the exit port is positioned on a second axis, and the second axis is spaced-apart and parallel to the first axis, such that the opening and the exit port are positioned in a non-aligned configuration, and wherein sheet material disposed in the dispenser flows on a third axis which intersects both the first and second axis through the opening in the base and the exit port in a circuitous path.

2. The single use disposable dispenser of claim 1, wherein the housing comprises a box folded into a shipping carton and a dispenser housing.

3. The single use disposable dispenser of claim 2, wherein the housing includes an outer flap having an exit port formed therein.

4. The single use disposable dispenser of claim 3, wherein the box includes inner flaps having semi-circular openings provided in an edge are positioned adjacent the outer flap, the semi-circular openings permitting the sheet material to flow therethrough to the exit port.

5. The single use disposable dispenser of claim 2, wherein the housing includes apertures which permit it to be attached to a surface. ,

6. The single use disposable dispenser of claim 2, wherein the housing includes at least one attachment member which permits it to be attached to a surface, and wherein the attachment member is selected from the group consisting of a fastener, a hook, a hook and loop material, and an adhesive.

7. The single use disposable dispenser of claim 1, wherein the base includes perimeter sidewalls which space the base a distance from the lower end of the dispenser housing.

8. The single use disposable dispenser of claim 7, wherein the base includes landings which support an outer periphery of a roll a distance above the base to facilitate flow of sheet material from a roll.

9. The single use disposable dispenser of claim 7, wherein the base includes a central area which is recessed, and wherein the opening in the base is formed in the central area.

10. The single use disposable dispenser of claim 1, wherein the opening in the base and the exit port is formed by perforations which, when expanded, provide a tab which is removed to provide the opening in the base and the exit port.

11. A single use disposable dispenser adapted to dispense sheet material, the dispenser comprising:

a housing configured to provide a shipping carton and a dispenser housing, the housing comprising an internal compartment, positioned within the internal compartment is a base having a central area and an opening therein positioned on a first axis, the base configured to support sheet material above at least a portion of the central area, the housing comprising an exit port positioned a distance from the opening in the base, wherein the exit port is positioned on a second axis, and the second axis is spaced apart and parallel to the first axis, and wherein sheet material disposed in the dispenser flows on a third axis which intersects both the first and second axis through the opening in the base and the exit port in a circuitous path.

12. The single use disposable dispenser of claim 11, wherein the housing comprises a box folded into a shipping carton and a dispenser housing.

13. The single use disposable dispenser of claim 12, wherein the box includes an outer flap having an exit port formed therein.

14. The single use disposable dispenser of claim 13, wherein the box includes inner flaps having semi-circular openings provided in an edge are positioned adjacent the outer flap, the semi-circular openings permitting the sheet material to flow therethrough to the exit port.

15. The single use disposable dispenser of claim 11, wherein the base includes perimeter sidewalls which space the base a distance from the lower end of the dispenser housing.

16. The single use disposable dispenser of claim 15, wherein the base includes landings which support an outer periphery of a roll a distance above the base to facilitate flow of sheet material from a roll.

17. A single use disposable dispenser adapted to dispense sheet material, the dispenser comprising:

a housing configured to provide a shipping carton and a dispenser housing, the housing including a lower end and an exit port located in the lower end, the housing configured to support sheet material therein; and a means positioned within the housing for controlling the movement of sheet material disposed in the housing through the exit port, the controlling means including a base having an opening therein spaced apart from the lower end of the housing and the exit port formed in the lower end of the housing, the opening in the base and the exit port are positioned in a non-aligned configuration, wherein the opening in the base is positioned on a first axis and the exit port in the lower end of the housing is positioned on a second axis, and the second axis is spaced-apart and parallel to the first axis, and wherein the controlling means is configured to provide a circuitous path for the flow of sheet material such that sheet material flows on a third axis which intersects both the first and second axis from the housing through the exit port.

18. The single use disposable dispenser of claim 17, wherein the housing comprises a box folded into a shipping carton and a dispenser housing.

19. The single use disposable dispenser of claim 18, wherein the box includes an outer flap having an exit port formed Therein and inner flaps having semi-circular openings provided in an edge are positioned adjacent the outer flap, the semi-circular openings permitting the sheet material to flow therethrough to the exit port.

20. The single use disposable dispenser of claim 17, wherein the base includes perimeter sidewalls which space the base a distance from the lower end of the dispenser housing, and the base includes landings which support an outer periphery of a roll a distance above the base to facilitate flow of sheet material from a roll.

* * * * *